US010930989B2

(12) United States Patent
Yoshida et al.

(10) Patent No.: US 10,930,989 B2
(45) Date of Patent: Feb. 23, 2021

(54) STRUCTURAL BODY, LAMINATED STRUCTURE OF STRUCTURAL BODY, AND ANTENNA STRUCTURE

(71) Applicant: NEC Corporation, Tokyo (JP)

(72) Inventors: Takahide Yoshida, Tokyo (JP); Hiroshi Toyao, Tokyo (JP); Eiji Hankui, Tokyo (JP)

(73) Assignee: NEC CORPORATION, Tokyo (JP)

( * ) Notice: Subject to any disclaimer, the term of this patent is extended or adjusted under 35 U.S.C. 154(b) by 245 days.

(21) Appl. No.: 16/086,094

(22) PCT Filed: Mar. 27, 2017

(86) PCT No.: PCT/JP2017/012379
§ 371 (c)(1),
(2) Date: Sep. 18, 2018

(87) PCT Pub. No.: WO2017/170394
PCT Pub. Date: Oct. 5, 2017

(65) Prior Publication Data

US 2020/0295429 A1 Sep. 17, 2020

(30) Foreign Application Priority Data

Mar. 31, 2016 (JP) ..... JP2016-070663

(51) Int. Cl.
*H01Q 13/10* (2006.01)
*H01P 3/08* (2006.01)
*H01Q 1/38* (2006.01)

(52) U.S. Cl.
CPC ..... *H01P 3/087* (2013.01); *H01Q 1/38* (2013.01)

(58) Field of Classification Search
CPC ..... H01Q 1/38; H01Q 13/10; H01Q 13/16; H01Q 21/06; H01Q 21/08; H01P 3/08; H01P 1/203; H01P 3/087
See application file for complete search history.

(56) References Cited

U.S. PATENT DOCUMENTS 5,355,104 A 10/1994 Wolfson et al.
8,952,266 B2 * 2/2015 Toyao ..... H01P 1/2005 174/262
2013/0140071 A1 6/2013 Toyao et al.

FOREIGN PATENT DOCUMENTS

EP 0 608 889 A1 8/1994
JP 02-171004 A 7/1990
(Continued)

OTHER PUBLICATIONS

International Search Report of PCT/JP2017/012379 dated Jun. 6, 2017 [PCT/ISA/210].
(Continued)

*Primary Examiner* — Hoang V Nguyen
(74) *Attorney, Agent, or Firm* — Sughrue Mion, PLLC

(57) ABSTRACT

It has been difficult to suppress electromagnetic wave that propagates within a suspended substrate. The structure according to the present invention is provided with: a first conductor plane and a second conductor plane that are disposed parallel to each other; a dielectric plane that is disposed between the first and second conductor planes via a hollow region so as to be parallel to the first and second conductor planes; a first transmission line disposed on a surface that is of the dielectric plane and that opposes the first conductor plane; and a second transmission line disposed on a surface that is of the dielectric plane and that opposes the second conductor plane, wherein the first transmission line and the second transmission line are electrically connected to each other.

9 Claims, 14 Drawing Sheets

(56) References Cited

FOREIGN PATENT DOCUMENTS

| | | | |
|---|---|---|---|
| JP | 07-7303 | A | 1/1995 |
| WO | 2012/042717 | A1 | 4/2012 |

OTHER PUBLICATIONS

Written Opinion of PCT/JP2017/012379 dated Jun. 6, 2017 [PCT/ISA/237].

* cited by examiner

STRUCTURAL BODY, LAMINATED STRUCTURE OF STRUCTURAL BODY, AND ANTENNA STRUCTURE

CROSS REFERENCE TO RELATED APPLICATIONS

This application is a National Stage of International Application No. PCT/JP2017/012379, filed Mar. 27, 2017, claiming priority based on Japanese Patent Application No. 2016-070663, filed Mar. 31, 2016, the contents of all of which are incorporated herein by reference in their entirety.

TECHNICAL FIELD

The present invention relates to a structure body, layered structure of a structure body, and an antenna structure.

BACKGROUND ART

In a device using a high frequency electromagnetic wave such as an antenna device or a wireless communication device, a structure body including a transmission line a part of which is hollow is used in order to suppress a loss at the transmission line. An art related to such a structure body is disclosed in Patent Literature 1 (PTL1).

PTL1 discloses an art related to a suspended substrate. A suspended substrate is provided with parallel flat plates including two conductor planes that are substantially parallel to each other and a dielectric substrate disposed between the parallel flat plates in a floating manner. The dielectric substrate is provided with a signal line that forms a transmission line. Having a hollow part as a part of the gap between the parallel flat plates reduces dielectric material, thereby suppressing dielectric loss. As a result, a high frequency signal is transmitted efficiently.

CITATION LIST

Patent Literature

[PTL1] EP0608889

SUMMARY OF INVENTION

Technical Problem

A problem in the related art is the difficulty in suppressing an electromagnetic wave that propagates inside the suspended substrate.

Generally, at a point with discontinuous characteristic impedance or in a situation that high-mode is generated, there is a possibility that a part of the high frequency signal that propagates in the transmission line does not propagate along the signal line and is emitted as an electromagnetic wave, and leaks to the inside of the parallel flat plates. When the electromagnetic wave leaks to the inside of the parallel flat plates (hereinafter the electromagnetic wave that leaks is referred to as leaked electromagnetic wave), the leaked electromagnetic wave has a possibility to cause coupling to other devices or to emit to the outside. Thus, sometimes leakage countermeasure such as short-circuiting the parallel flat plates is performed. However, since a suspended substrate has a hollow region in a part of the substrate, it is difficult to short-circuit the parallel flat plates.

An objective of the present invention is to provide a structure body that suppresses the leaked electromagnetic wave that propagates inside the suspended substrate, a layered structure of the structure body, and an antenna structure.

Solution to Problem

A structure body in the present invention comprises:

a first conductor plane and a second conductor plane disposed in parallel;

a dielectric plane that is disposed in parallel to the first conductor plane and the second conductor plane between the first conductor plane and the second conductor plane via a hollow region;

a first transmission line that is disposed on a surface facing the first conductor plane of the dielectric plane, at least one of whose ends is an open end; and a second transmission line that is disposed on a surface facing the second conductor plane of the dielectric plane, at least one of whose ends is an open end;

wherein the first transmission line and the second transmission line are electrically connected to each other.

A layered structure in the present invention comprises:

a first conductor plane and a second conductor plane disposed in parallel;

a third conductor plane that is disposed in parallel to the first conductor plane and the second conductor plane, and in parallel to the surface of the second conductor plane opposite to the surface facing the first conductor plane;

a first dielectric plane that is disposed in parallel to the first conductor plane and the second conductor plane between the first conductor plane and the second conductor plane via a hollow region;

a second dielectric plane that is disposed in parallel to the second conductor plane and the third conductor plane between the second conductor plane and the third conductor plane via another hollow region;

a first transmission line that is disposed on a surface of the first dielectric plane facing the first conductor plane, and on a surface of the second dielectric plane facing the surface of the second conductor plane, and at least one end of which is an open end;

a second transmission line that is disposed on a surface of the first dielectric plane facing the second conductor plane and on a surface of the second dielectric plane facing the third conductor plane, and at least one end of which is an open end;

a first suspended transmission line that is disposed on the first dielectric plane, and one end of which is an open end; and a second suspended transmission line that is disposed on the second dielectric plane, and one of which is an open end;

wherein the second conductor plane includes an opening at a position opposing to an open end of the first suspended transmission line and an open end of the second suspended transmission line;

wherein the first transmission line and the second transmission line are electrically connected to each other; and a plurality of unit structures are disposed to surround open ends of the first suspended transmission line and the second suspended transmission line, where the unit structure is configured by the first transmission line and the second transmission line.

An antenna structure in the present invention comprises:

a first conductor plane and a second conductor plane disposed in parallel;

a dielectric plane that is disposed in parallel to the first conductor plane and the second conductor plane between the first conductor plane and the second conductor plane via a hollow region;

a first transmission line that is disposed on a surface facing the first conductor plane of the dielectric plane, at least one end of which is an open end; and a second transmission line that is disposed on a surface of the dielectric plane facing the second conductor plane, at least one end of which is an open end; and a suspended transmission line that is disposed on the dielectric plane, and one of which is an open end;

wherein the first conductor plane includes an opening at a position opposing to an open end of the suspended transmission line;

the first transmission line and the second transmission line are electrically connected to each other; and a plurality of unit structures are disposed to surround an open end of the suspended transmission line, wherein the unit structure is configured by the first transmission line and the second transmission line.

Advantageous Effect of Invention

The effect of the present invention is that the structure body, the layered structure thereof and the antenna structure suppress the leaked electromagnetic wave that propagates inside the suspended substrate.

EXAMPLE EMBODIMENT

Figure 1A:
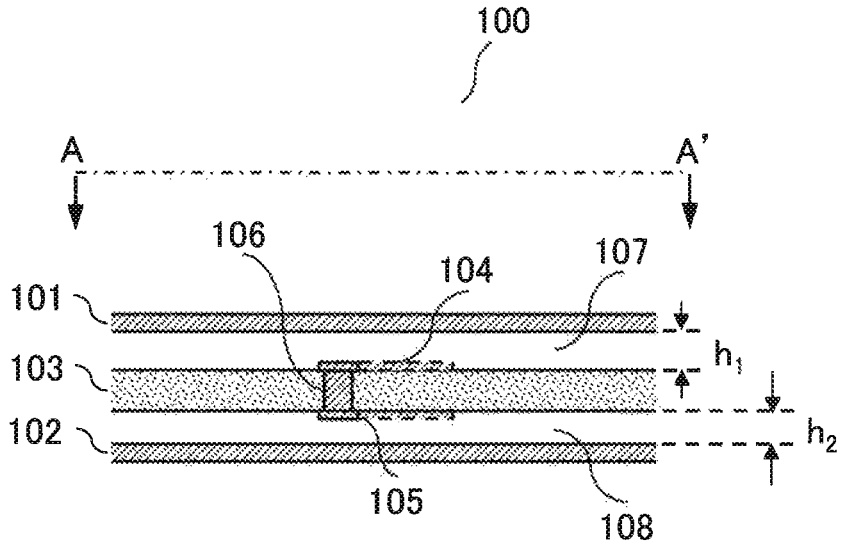
FIGS. 1A to 1C are cross-sectional views illustrating a configuration of a structure body 100 of the first example embodiment of the present disclosure.

Hereinafter, with reference to the drawings, the example embodiments of the present invention are described in detail. Note that, in each drawing and each example embodiment in the description, same reference numerals are used to such the component provided with similar function.

First Example Embodiment

Figure 1B:
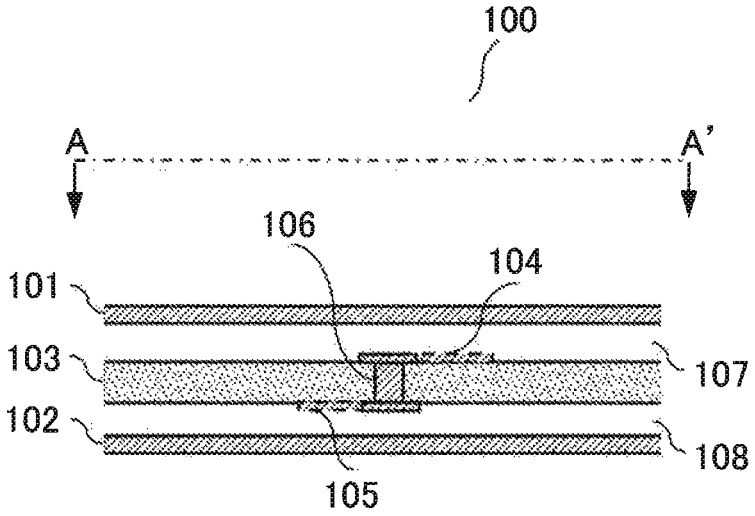
Figure 1C:
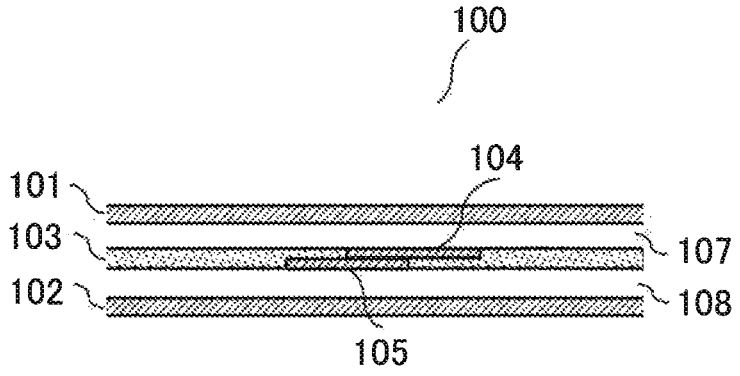
Figure 2A:
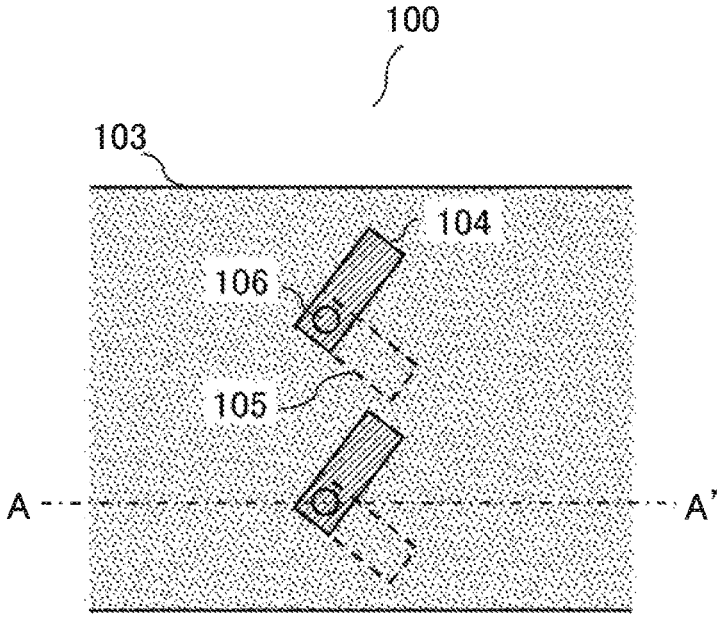
FIGS. 2A and 2B are top views illustrating a configuration of the structure body 100 of the first example embodiment of the present disclosure.
Figure 2B:
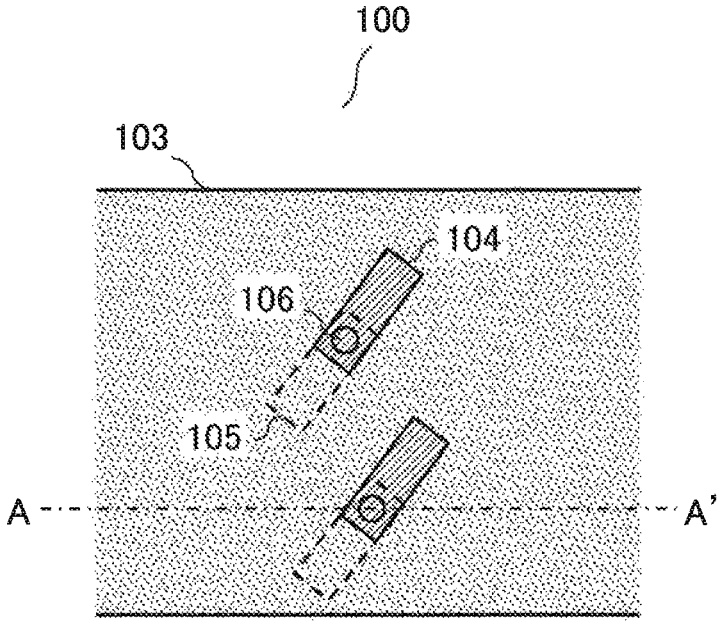

FIG. 1 and FIG. 2 are diagrams illustrating a configuration of the structure body 100 of the first example embodiment of the present disclosure. FIGS. 1A and 1B are cross-sectional views in A-A' of the structure body 100 illustrated in FIGS. 2A and 2B, respectively. FIG. 2 is a top view of the structure body 100 as viewed from a first conductor plane 101 side out of the directions perpendicular to the first conductor plane 101 (hereinafter, the top is defined similarly herein).

The structure body 100 is configured by provided with a parallel flat plate configured by provided with a first conductor plane 101 and a second conductor plane 102 that are substantially parallel to each other, a dielectric plane 103 disposed therebetween, a first transmission line 104 having the dielectric plane 103 as the support member and disposed on the surface of the first conductor plane 101 side, a second transmission line 105 that is disposed on the surface of the second conductor plane 102 side of the dielectric plane 103, and a conductor via 106 that connects the first transmission line 104 and the second transmission 105.

The dielectric plane 103 has hollow regions 107 and 108, sandwiched with the first conductor plane 101 and sandwiching with the second conductor plane 102, respectively.

One end of each of the first transmission line 104 and the second transmission line 105 is an open end, and the other ends are coupled to each other by the conductor via 106. The first transmission line 104 and the second transmission line 105 are disposed in such a way that each open end does not overlap in the top view (refer to FIG. 2).

For example, in the structure body 100, the first transmission line 104 and the second transmission line 105 may be disposed in a V-shape as illustrated in FIG. 1A and FIG. 2A, or may be disposed in an I-shape as illustrated in FIG. 1B and FIG. 2B.

The structure body 100 may not necessarily use the conductor via 106 in the case the first transmission line 104 and the second transmission line 105 can be connected to each other, as illustrated in FIG. 1C. As illustrated in FIG. 1C, in the structure body 100, the first transmission line 104 and the second transmission line 105 may be disposed in different layers without using the conductor via 106, and an end that is not the open end of each of the first transmission line 104 and the second transmission line 105 may contact each other and be electrically connected.

Figure 3A:
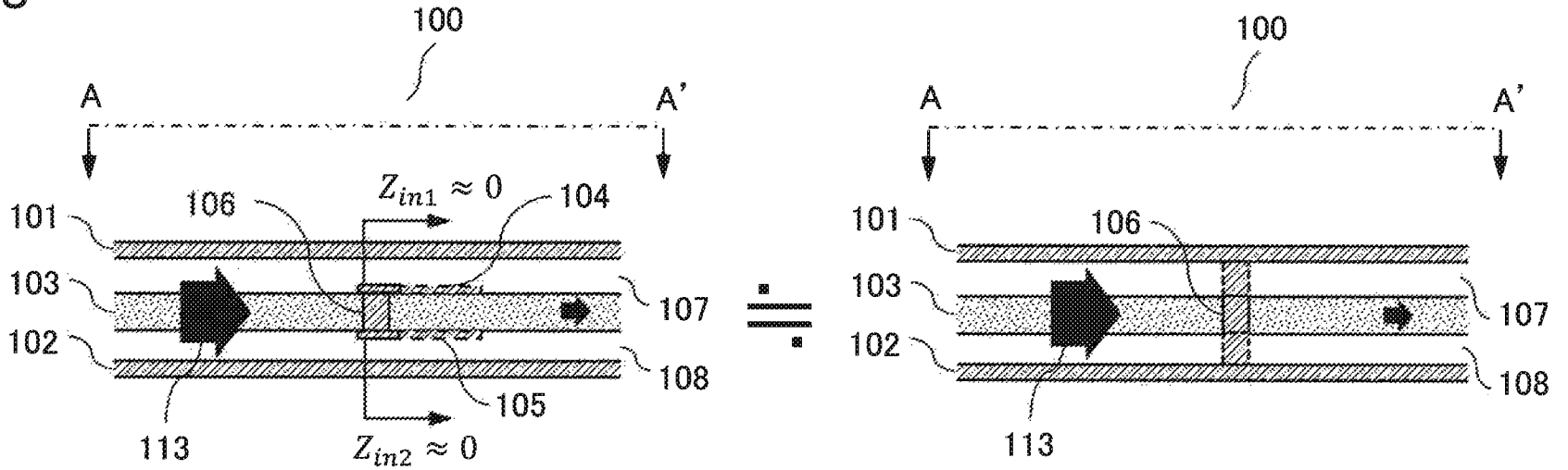
FIGS. 3A and 3B are diagrams illustrating an operation of the structure body of the first example embodiment of the present disclosure.

FIG. 3 is a diagram describing an operation of the structure body 100 illustrated in FIG. 1A. FIG. 3A is a cross-sectional view in A-A' of the structure body 100, and FIG. 39 is a top view of the structure body 100. The operations of the structure body 100 in FIGS. 1B and 1C can be described in the similar principle as FIG. 3.

With the structure body 100 of the example embodiment, when the impedance Z between the parallel flat plates configured by provided with the first conductor plane 101 and the second conductor plane 102 is substantially zero or inductive, the propagation constant is an imaginary number, and therefore the propagation of the electromagnetic wave can be suppressed. Especially, the suppressing effect is high when the impedance Z is substantially zero.

In the structure body 100, in the case the leaked electromagnetic wave 113 propagates between the parallel flat plates configured by provided with the first conductor plane 101 and the second conductor plane 102 (i.e. in the case of propagation through a unit structure including the first transmission line 104, the second transmission line 105 and the conductor via 106), electric field distribution is induced between the first transmission line 104 and the first conductor plane 101, and between the second transmission line 105 and the second conductor plane 102, and the first transmission line 104 and the second transmission line 105 operate as stubs.

It is assumed that the input impedance between the transmission line 104 and the conductor plane 101 when viewed from the conductor via 106 side to the open end side of the first transmission line 104 is $Z_{in1}$, and the input impedance between the transmission line 105 and the conductor plane 102 when viewed from the conductor via 106 side to the open end side of the second transmission line 105 is $Z_{in2}$. Here, the impedance Z between the parallel flat plates configured by provided with the first conductor plane 101 and the second conductor plane 102 is expressed substantially by the sum of $Z_{in1}$, the inductance of the conductor via 106 and $Z_{in2}$.

In order to suppress the leaked electromagnetic wave 113, the first transmission line 104 and the second transmission line 105 are preferably designed to satisfy the following relationship: for example, the length L from the connection to the conductor via 106 to each open end is substantially $L=(2n+1)\times\lambda/4$, where $\lambda$ is the wavelength at the operating frequency. Here, the parameter n is an integer equal to or larger than 0, and n=0, 1, 2, 3, . . . , n.

With the structure body 100 taking the above configuration, in the first transmission line 104 and the first conductor plane 101, the input impedance $Z_{in1}$ between the transmission line 104 and the conductor plane 101 when seeing the open end side of the first transmission line 104 from the conductor via 106 side becomes substantially zero. This means that the first transmission line 104 and the first conductor plane 101 are short-circuited.

Similarly, in the second transmission line 105 and the second conductor plane 102, the input impedance $Z_{in2}$ between the transmission line 105 and the conductor plane 102 when seeing the open end side of the second transmission line 105 from the conductor via 106 side becomes substantially zero. This means that the second transmission line 105 and the second conductor plane 102 are short-circuited.

Figure 3B:
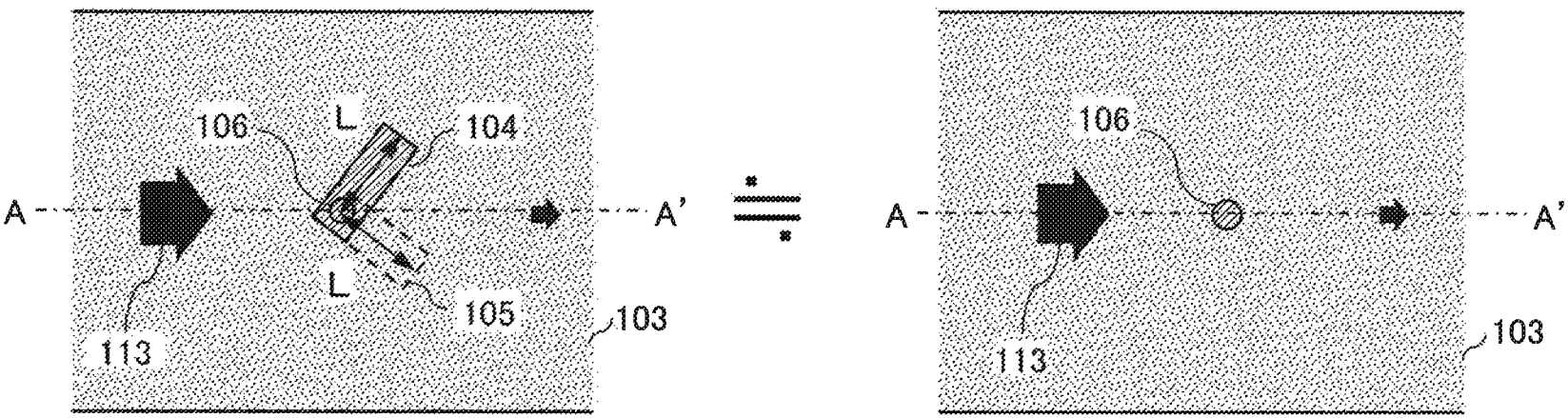

The above effect and the inductance of the conductor via 106, the structure body 100 can make the impedance Z between the first conductor plane 101 and the second conductor plane 102 inductive, as illustrated in the right side of FIGS. 3A and 3B. As a result, the structure body 100 can suppress the propagation of the leaked electromagnetic wave 113. Especially, when the inductance of the conductor via 106 is sufficiently small, the impedance Z between the first conductor plane 101 and the second conductor plane 102 can be regarded as substantially zero. In this case, the structure body 100 can further suppress the propagation of the leaked electromagnetic wave 113.

In the structure body 100 of the first example embodiment, the coupling between the first transmission line 104 and the second transmission line 105 can be suppressed by disposing the first transmission line 104 and the second transmission line 105 in such a way as to the open ends thereof do not overlap in a top surface view.

In the example embodiment, the first transmission line 104 and the second transmission line 105 may be any length as long as the impedance Z between the parallel flat plates configured by provided with the first conductor plane 101 and the second conductor plane 102 is substantially zero or inductive.

Figure 4:
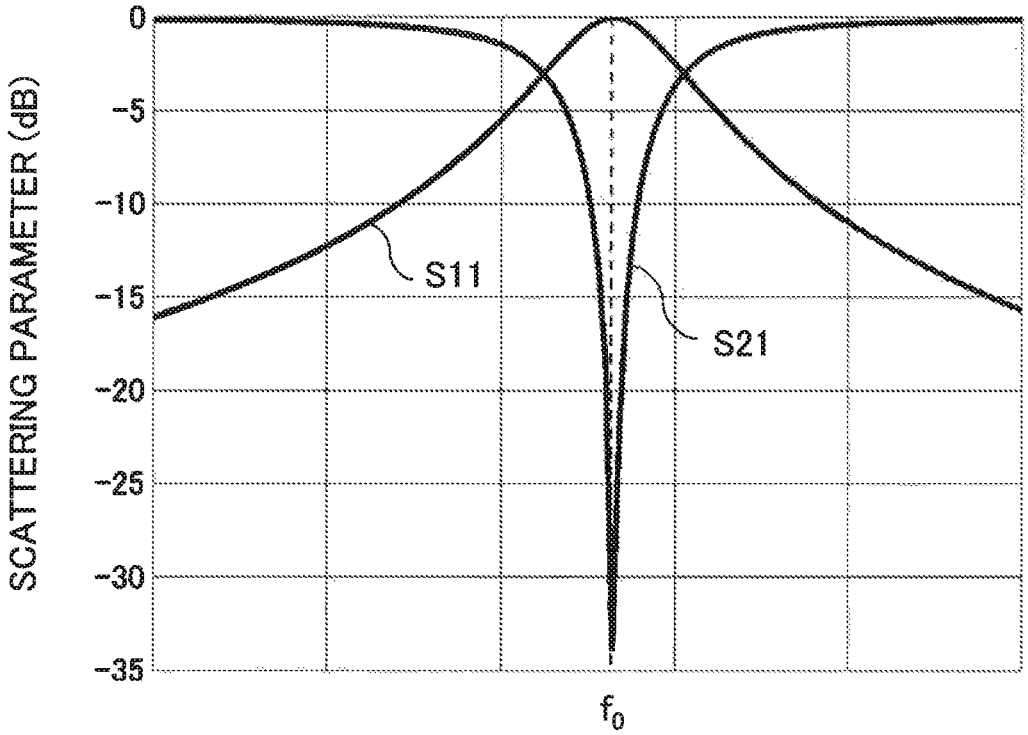
FIG. 4 is a diagram illustrating scattering parameters of the structure body 100 of the first example embodiment of the present disclosure.

Scattering parameters related to the structure body 100 of the example embodiment are illustrated in FIG. 4. It is assumed that, in the structure body 100 illustrated in FOG. 1A, when assuming the left edge as analysis port 1 and right edge as analysis port 2, the scattering parameter representing the magnitude of the power reflection of the Transverse Electromagnetic (TEM) wave to the analysis port 1 is S11, and the scattering parameter representing the magnitude of the power transmittance from the analysis port 1 to the analysis port 2 is S21. According to FIG. 4, at a predetermined frequency $f_0$, S11 shows a high peak and S21 shows a low peak. The meaning is that the propagation of the TEM wave is suppressed by the unit structure including the first conductor plane 101, the first transmission line 104 and the conductor via 106, and the unit structure including the second conductor plane 102, the second transmission line 105 and the conductor via 106.

With reference to FIG. 4, the structure body 100 of the example embodiment is effective for suppressing the propagation of the leaked electromagnetic wave in the parallel flat plates.

Note that the connection of the first transmission line 104 and the second transmission line 105 may not necessarily be the ends of the first transmission line 104 and the second transmission line 105, but may be any points except for the open ends.

The thicknesses $h_1$ and $h_2$ of the hollow regions 107 and 108 of the first example embodiment respectively may be equal or unequal to each other.

Second Example Embodiment

The structure body 200 of the second example embodiment of the present disclosure is described with reference to FIG. 5.

Figure 5:
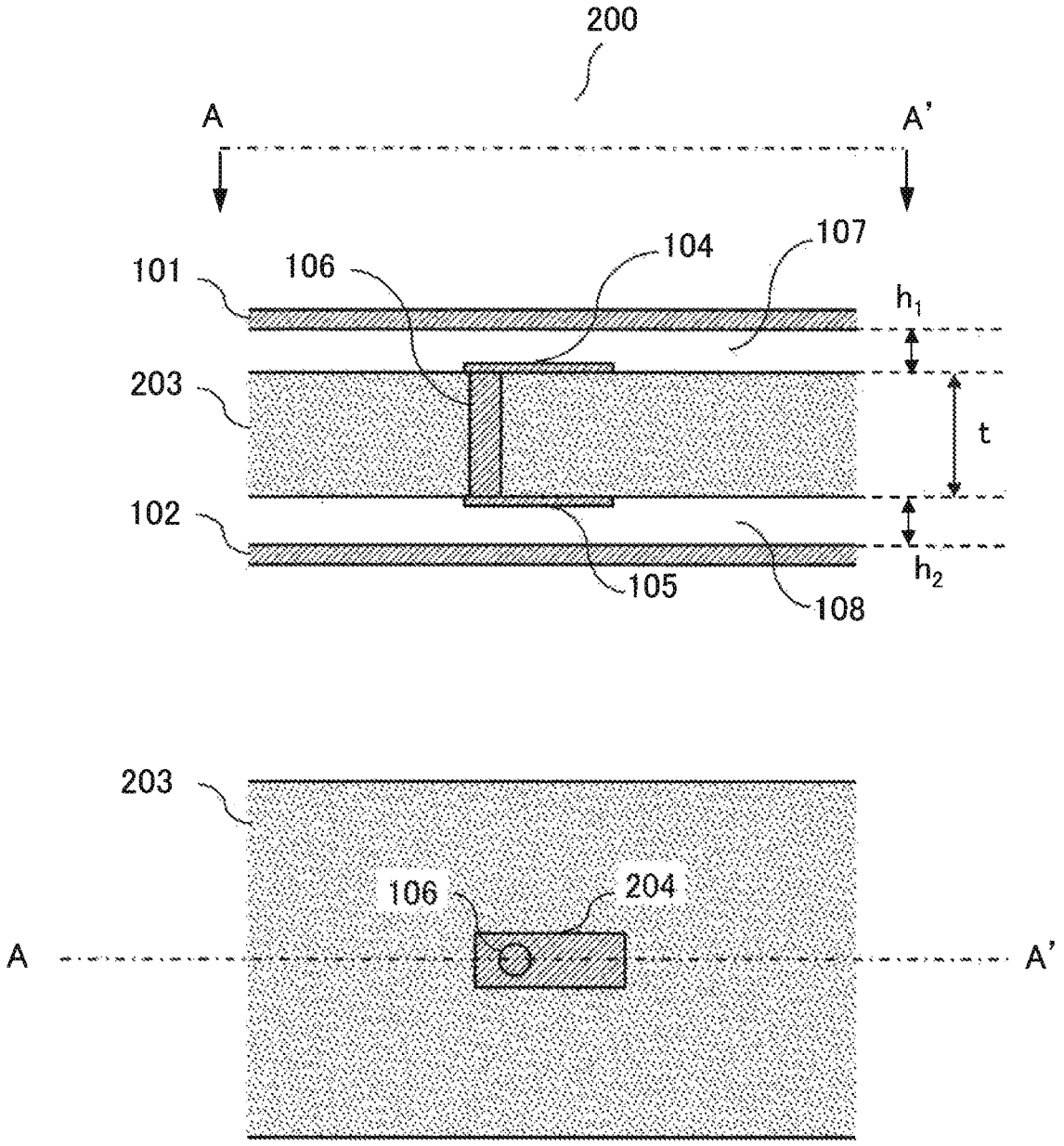
FIG. 5 is a diagram illustrating a configuration of a structure body 200 of the second example embodiment of the present disclosure.

The structure body 200 in FIG. 5 is different from the structure body 100 of the first example embodiment in that the first transmission line 104 and the second transmission line 105 are disposed in an overlapping manner when viewed from the top (from the first conductor plane side out of the directions perpendicular to the first conductor plane), and t is greatly different from $h_1$ and $h_2$ when $h_1$ and $h_2$ are the thicknesses of the hollow regions 107 and 108 respectively, and t is the thickness of a dielectric plane 203. In the structure body 200, since t is set to be larger than $h_1$ and $h_2$, even when the open ends of the first transmission line 104 and the second transmission line 105 are disposed to overlap when viewed from the top, the coupling between the stubs are suppressed, and therefore, in a similar manner to the first example embodiment, the propagation of the leaked electromagnetic wave in the parallel flat plates can be suppressed.

Third Example Embodiment

Figure 6:
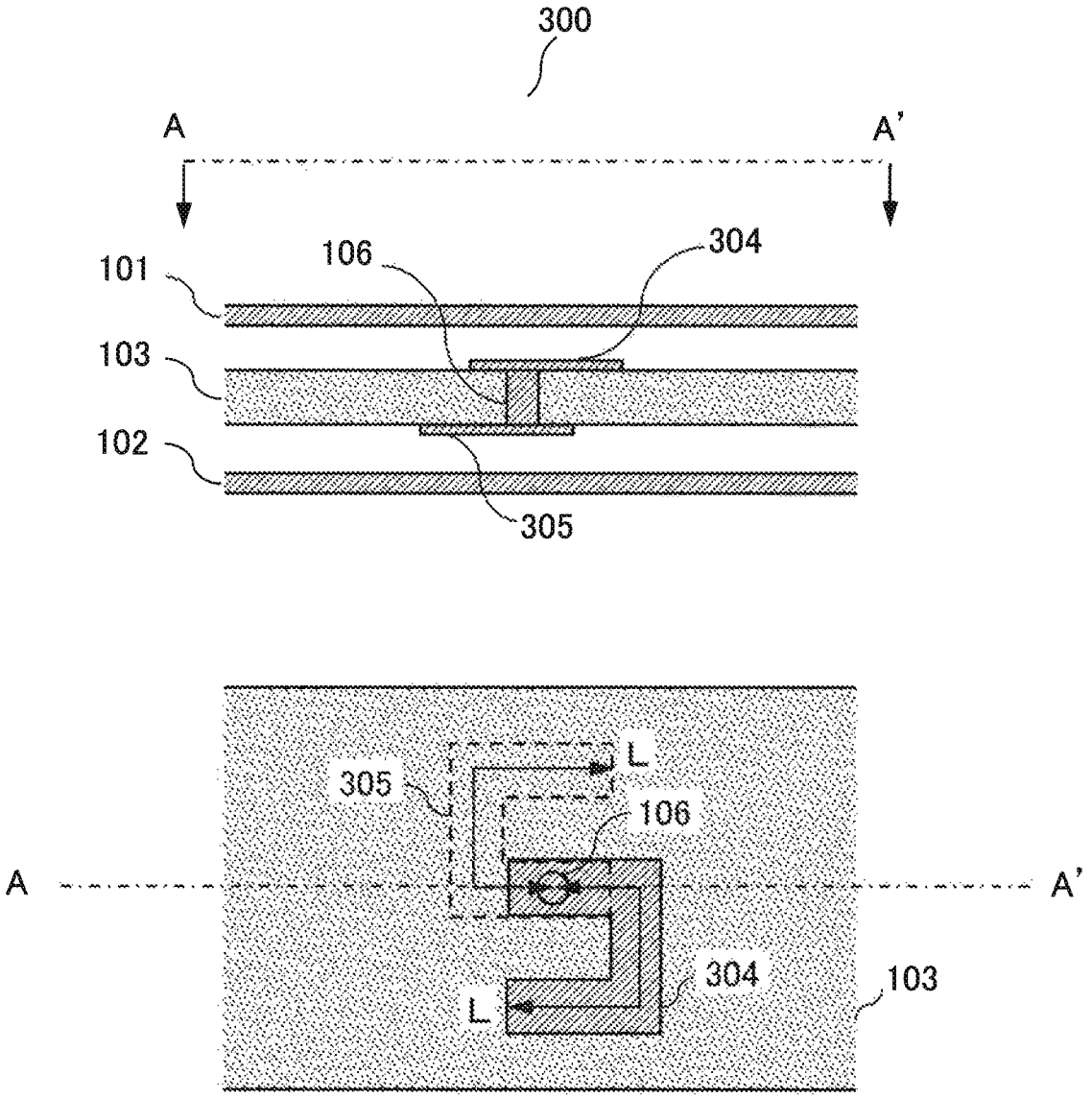
FIG. 6 is a diagram illustrating a configuration of a structure body 300 of the third example embodiment of the present disclosure.
Figure 7A:
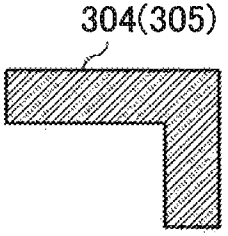
FIGS. 7A to 7D are diagrams illustrating a configuration of a variation of a first transmission line 304 and a second transmission line 305 of the third example embodiment of the present disclosure.
Figure 7B:
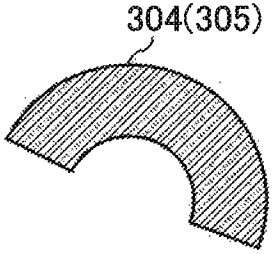
Figure 7C:
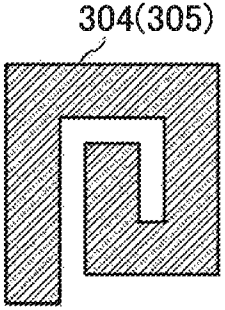
Figure 7D:
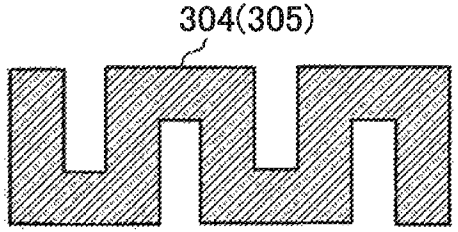

The structure body 300 of the third example embodiment of the present disclosure is described with reference to FIG. 6.

The structure body 300 of the third example embodiment is different from the structure body 100 of the first example embodiment in that the shape of the first transmission line 104 and the second transmission line 105 of the first example embodiment are not linear shape but folding back shape. Regarding to the structure body 300 of the third example embodiment, by flexibly mounting the shape of the first transmission line 304 and the second transmission line 305, the size of the structure body 300 can be decreased.

With the structure body 300 of the example embodiment, in a similar manner to the first example embodiment, the propagation of the leaked electromagnetic wave in the parallel flat plates can be suppressed.

In the example embodiment, the first transmission line 304 and the second transmission line 305 are U-shaped folding back shape however, other shape may be adopted. For example, L-shape, curved shape, spiral shape, meandering shape or the like as illustrated in FIGS. 7A to 7D may be adopted.

Fourth Example Embodiment

Figure 8:
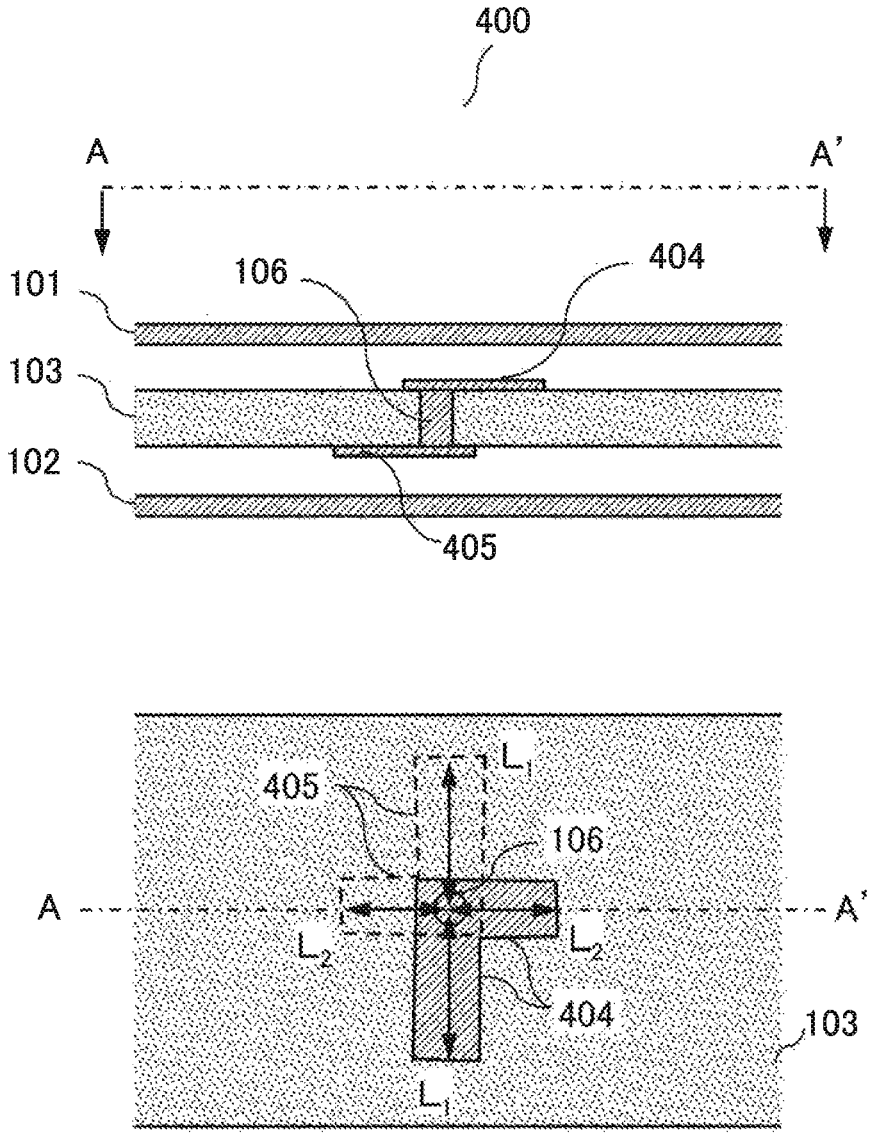
FIG. 8 is a diagram illustrating a configuration of a structure body 400 of the fourth example embodiment of the present disclosure.

The structure body 400 of the fourth example embodiment of the present disclosure is described with reference to FIG. 8.

In the structure body 400 of the fourth example embodiment, each of the first transmission line 404 and the second transmission line 405 has a plurality of branch wires. In the example embodiment, the number of branch wires is assumed to be two however, the number may be equal to or more than three. The two branch wires that are included by each of the first transmission line 404 and the second transmission line 405 respectively have different lengths $L_1$ and $L_2$, from the connection portion to the conductor via 106 to each open end. The branch wires whose lengths are different operate in different frequencies respectively, and the branch wires are adjusted to satisfy the following conditions.

The $L_1$ is designed to satisfy $L_1=(2s+1)\times\lambda_1/4$ for the $\lambda_1$ that is the wavelength at the operating frequency. Here, the parameter s is an integer equal to or larger than 0 and s=0, 1, 2, . . . , s.

Similarly, the $L_2$ is designed to satisfy $L_2=(2t+1)\times\lambda_2/4$, for the $\lambda_2$ that is the wavelength at the operating frequency. Here, the parameter t is an integer equal to or larger than 0, and t=0, 1, 2, . . . , t.

With the configuration described above, since the first transmission line 404 and the second transmission line 405 perform resonance operation at a plurality of frequencies originating from the length of each of the plurality of branch wires, the structure body 400 operates at a plurality of frequencies.

Fifth Example Embodiment

Figure 9:
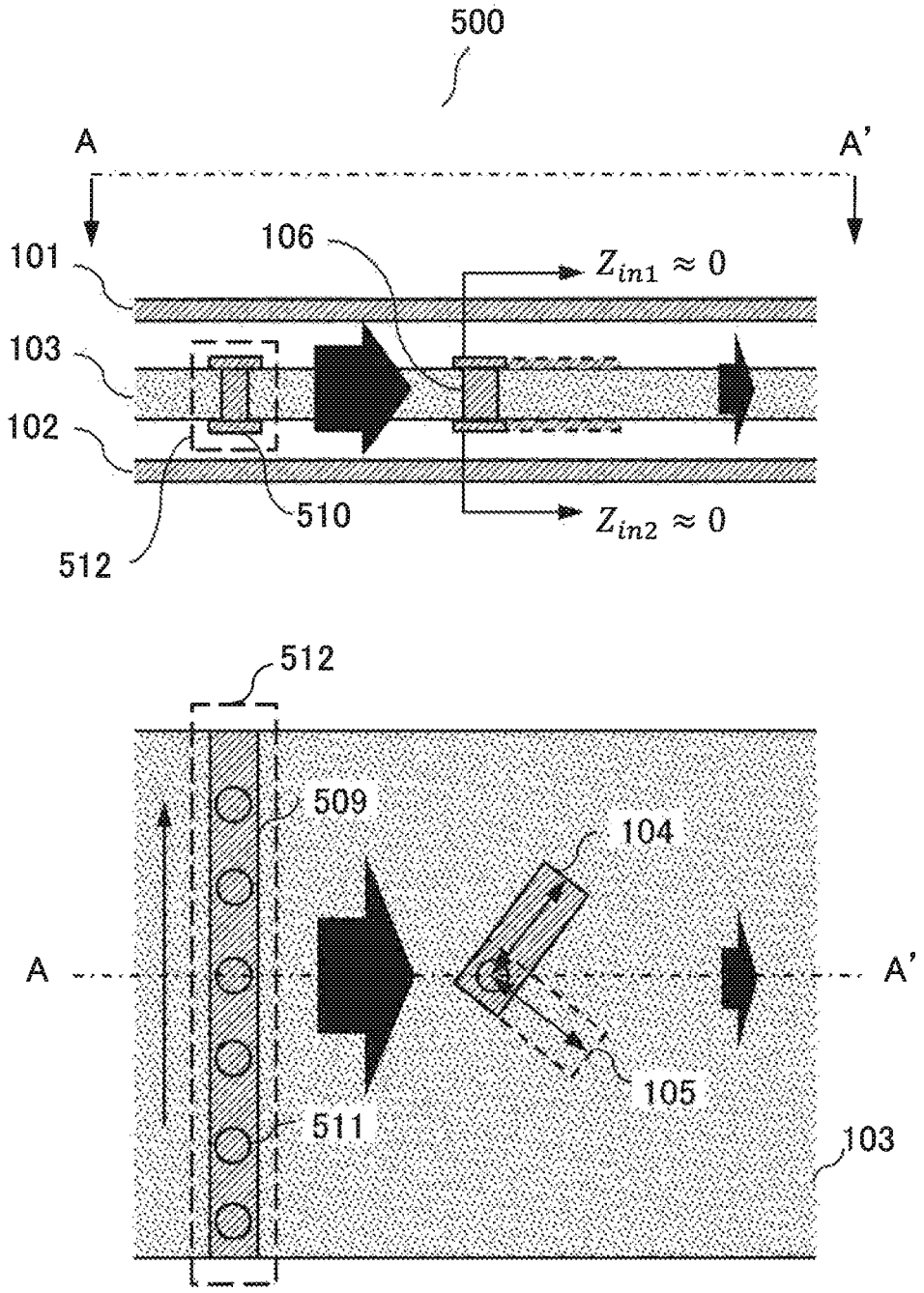
FIG. 9 is a diagram illustrating a configuration of a structure body 500 of the fifth example embodiment of the present disclosure.

The structure body 500 of the fifth example embodiment of the present disclosure is described with reference to FIG. 9 and FIG. 10.

The structure body 500 of the fifth example embodiment is different from the first example embodiment in that a suspended strip line 512 configured by provided with a third transmission line 509 and a fourth transmission line 510 and a plurality of conductor vias 511 on the dielectric plane 103 in addition to the configuration of the structure body 100 of the first example embodiment is disposed. On the structure body 500, a plurality of unit structure including a first transmission line 104, a second transmission line 105, and a conductor via 106 surrounding the suspended strip line 512 formed on the suspended substrate may be disposed. For example, the unit structure may be disposed periodically.

Figure 10:
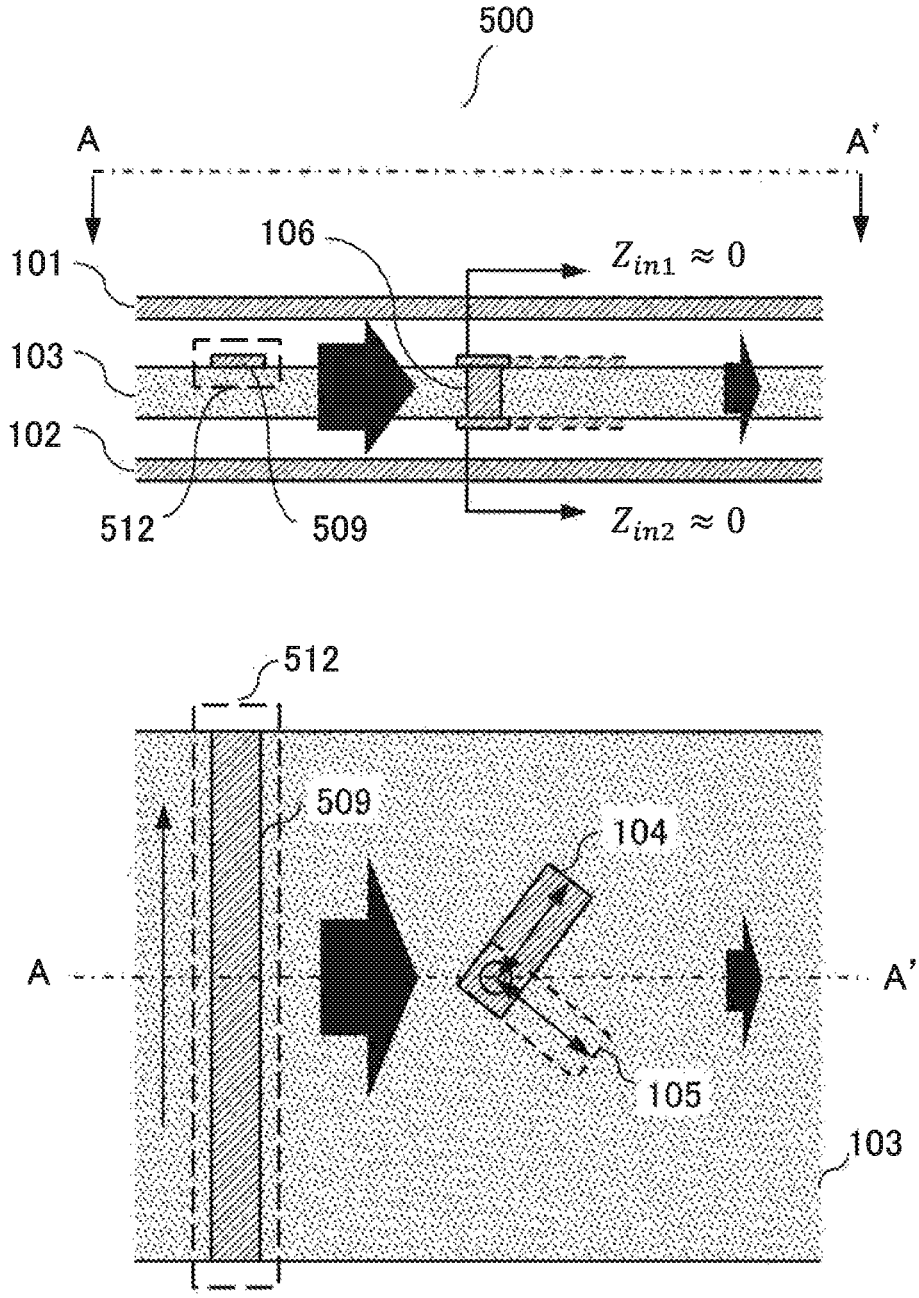
FIG. 10 is a diagram illustrating a configuration of a variation of the structure body 500 of the fifth example embodiment of the present disclosure.

In the suspended strip line 512, the fourth transmission line 510 and a plurality of conductor vias 511 may not necessarily be used, and only the third transmission line 509, as illustrated in FIG. 10, may be included.

Sixth Example Embodiment

The structure body 600 of the sixth example embodiment of the present disclosure is described with reference to FIG. 11.

Figure 11A:
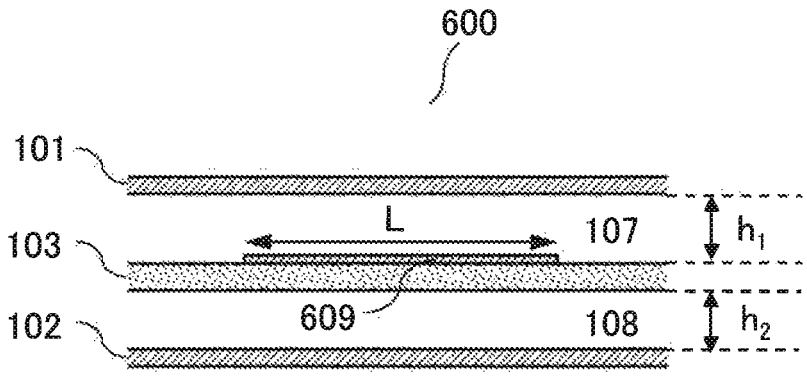
FIGS. 11A to 11C are diagrams illustrating a configuration of a structure body 600 of the sixth example embodiment of the present disclosure.

The structure body 600 of FIG. 11A is configured by provided with parallel flat plates configured by provided with the first conductor plane 101 and the second conductor plane 102 that are substantially parallel to each other, a dielectric plane 103 disposed therebetween, and a transmission line 609 whose length is L disposed on the dielectric plane 103.

Resonator operates when the length L of the transmission line 609 roughly satisfying relationship as $L=n\times\lambda/2$, where $\lambda$ is the wavelength at the operation frequency and n is an integer equal to or larger than 1, and the leaked electromagnetic wave that propagates in the parallel flat plates can be suppressed. Note that the thicknesses $h_1$ and $h_2$ of the hollow regions 107 and 108 may be equal or unequal to each other.

Figure 11B:
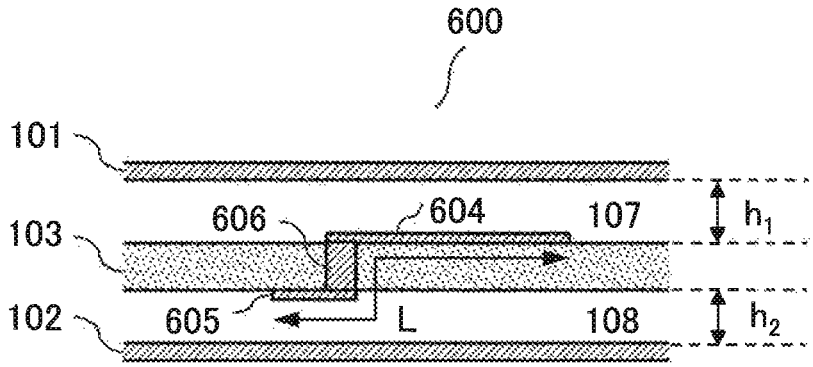

FIG. 11B illustrates a configuration that the transmission line 609 of FIG. 11A is replaced with the first transmission line 604, conductor via 606 and the second transmission line 605. An end of each of the first transmission line 604 and the second transmission line 605 that is not an open end is coupled to each other by conductor via 606. Similar to the length L of the transmission line 609 of the FIG. 11A, the total length L of the first transmission line 604, conductor via 606 and the second transmission line 605 preferably satisfies $L=n\times\lambda/2$ to the wavelength $\lambda$ at the operation frequency where n is an integer equal to or larger than 1, when the propagation of the leaked electromagnetic wave in the parallel flat plates is suppressed. Note that the thicknesses $h_1$ and $h_2$ of the hollow regions 107 and 108 may be equal or unequal to each other.

In FIG. 11B, the first transmission line 604 and the second transmission line 605 have different lengths from the coupling to the conductor via 606 to each open end. However, as a matter of course, the lengths of the first transmission line 604 and the second transmission line 605 from the coupling to the conductor via 606 to each open end may be equal.

Figure 11C:
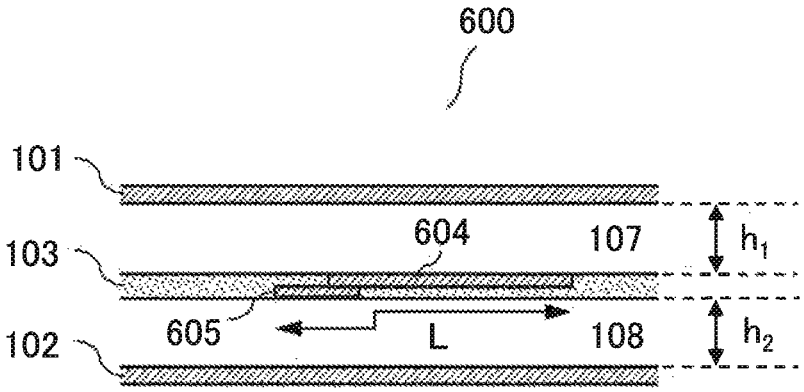

FIG. 11C illustrates a configuration that the transmission line 609 of FIG. 11A is replaced with the first transmission line 604 and the second transmission line 605. An end of each of the first transmission line 604 and the second transmission line 605 are disposed on different layers, and connected to each other at ends that are not the open ends. Here, similar to the length L of the transmission line 609 of the FIG. 11A, the total length L of the first transmission line 604 and the second transmission line 605 preferably satisfies $L=n\times\lambda/2$ to the wavelength $\lambda$ where n is an integer equal to or larger than 1, when the propagation of the high frequency signal in the parallel flat plates is suppressed. Note that the thicknesses $h_1$ and $h_2$ of the hollow regions 107 and 108 may be equal or unequal to each other.

In FIG. 11C, the first transmission line 604 and the second transmission line 605 have different lengths from the connection of the first transmission line 604 and the second transmission line 605 to each open end. However, as a matter of course, the lengths of the first transmission line 604 and the second transmission line 605 from the connection of the first transmission line 604 and the second transmission line 605 to each open end may be equal.

In the example embodiment, the first transmission line 604 and the second transmission line 605 have a linear shape; however, other shape may be adopted. For example, similar to the first transmission line 304 and the second transmission line 305 of the third example embodiment, various folding back shapes may be adopted.

Seventh Example Embodiment

The layered structure 700 of the seventh example embodiment of the present disclosure is described with reference to FIG. 12.

The layered structure 700 of the seventh example embodiment is the configuration when the structure body 500 of the fifth example embodiment is layered.

Figure 12:
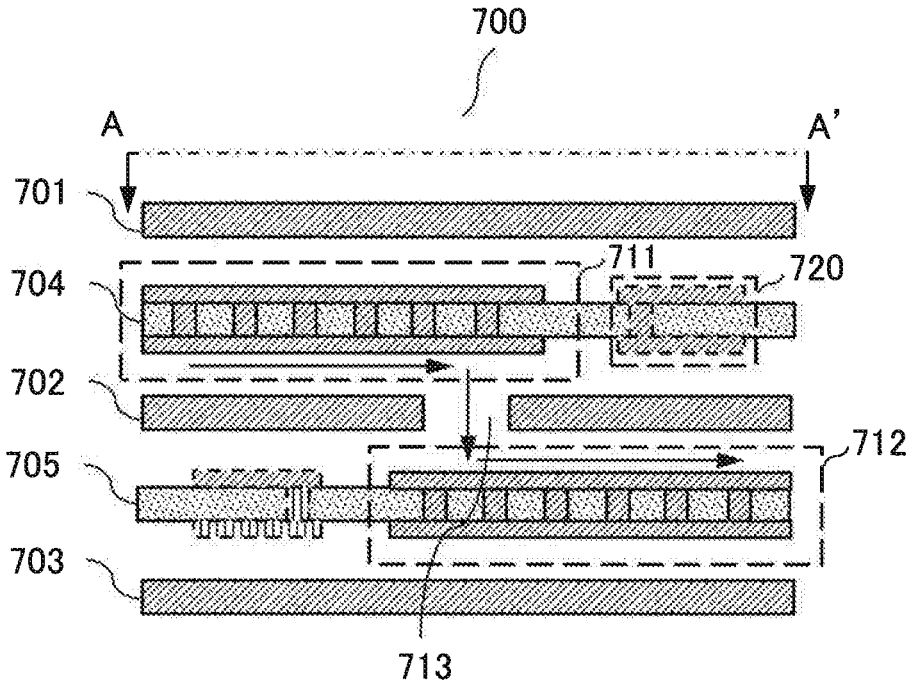
FIG. 12 is a diagram illustrating a configuration of the layered structure 700 of the seventh example embodiment of the present disclosure.
Figure 12:
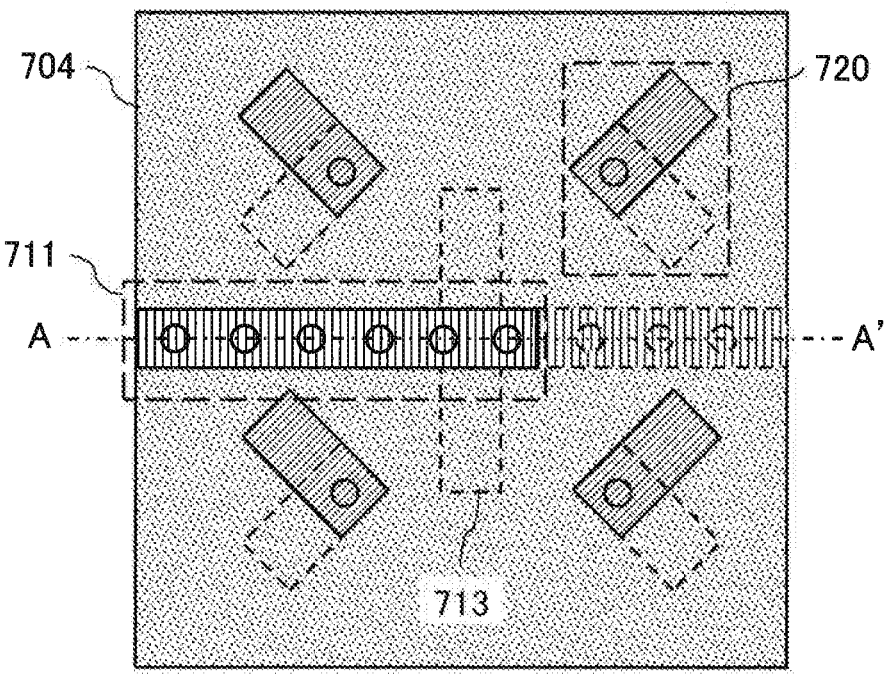

The layered structure 700 illustrated in FIG. 12 includes parallel flat plates formed by three planes that are a first conductor plane 701, a second conductor plane 702 and a third conductor plane 703, a first dielectric plane 704 and a second dielectric plane 705, a first suspended strip line 711 and a second suspended strip line 712 that are disposed on the first dielectric plane 704 and the second dielectric plane 705 respectively and one end of each is an open end, and a plurality of unit structures 720 disposed around each open end of the first suspended strip line 711 and the second suspended strip line 712.

The unit structure 720 is configured by the first transmission line 104, the second transmission line 105 and the conductor via 106 of the first example embodiment. Note that the conductor via 106 may not necessarily be included. By replacing the dielectric plane 103 of the first example embodiment with the first dielectric plane 704 and the second dielectric plane 705 of the example embodiment, the unit structure 720 can be configured as the first dielectric plane 704 and the second dielectric plane 705.

The unit structure 720 may be disposed periodically in the example embodiment.

The high frequency signal that propagates within the suspended strip line is transmitted from the first suspended strip line 711 to the second suspended strip line 712 via the slot 713 disposed on the second conductor plane 702, as illustrated by the arrows in FIG. 12. The high frequency signal may be transmitted from the second suspended strip line 712 to the first suspended strip line 711 via the slot 713 disposed on the second conductor plane 702, in the opposite direction of the arrows.

In the layered structure 700, when the plurality of unit structures 720 are not disposed, a part of the high frequency signal transmitted from the first suspended strip line 711 intrudes to the slot 713 and transmitted to the second suspended strip line 712, however, a part of the remaining high frequency signal has a possibility to propagate, not along the second suspended strip line 712, but to the inside of the two parallel flat plates formed by the first conductor plane 701, the second conductor plane 702 and the third conductor plane 703 as a leaked electromagnetic wave. This is because the characteristic impedance at the slot 713 and the open end of the suspended strip line is discontiguous with regard to the suspended strip line 711 and 712. In order to prevent the propagation of the leaked electromagnetic wave, a plurality of unit structures 720 are disposed in FIG. 12. As a result, the signal transmission between the suspended strip lines in the layered structure 700 can be performed efficiently.

Eighth Example Embodiment

The antenna structure 800 of the eighth example embodiment of the present disclosure is described with reference to FIG. 13.

Figure 13:
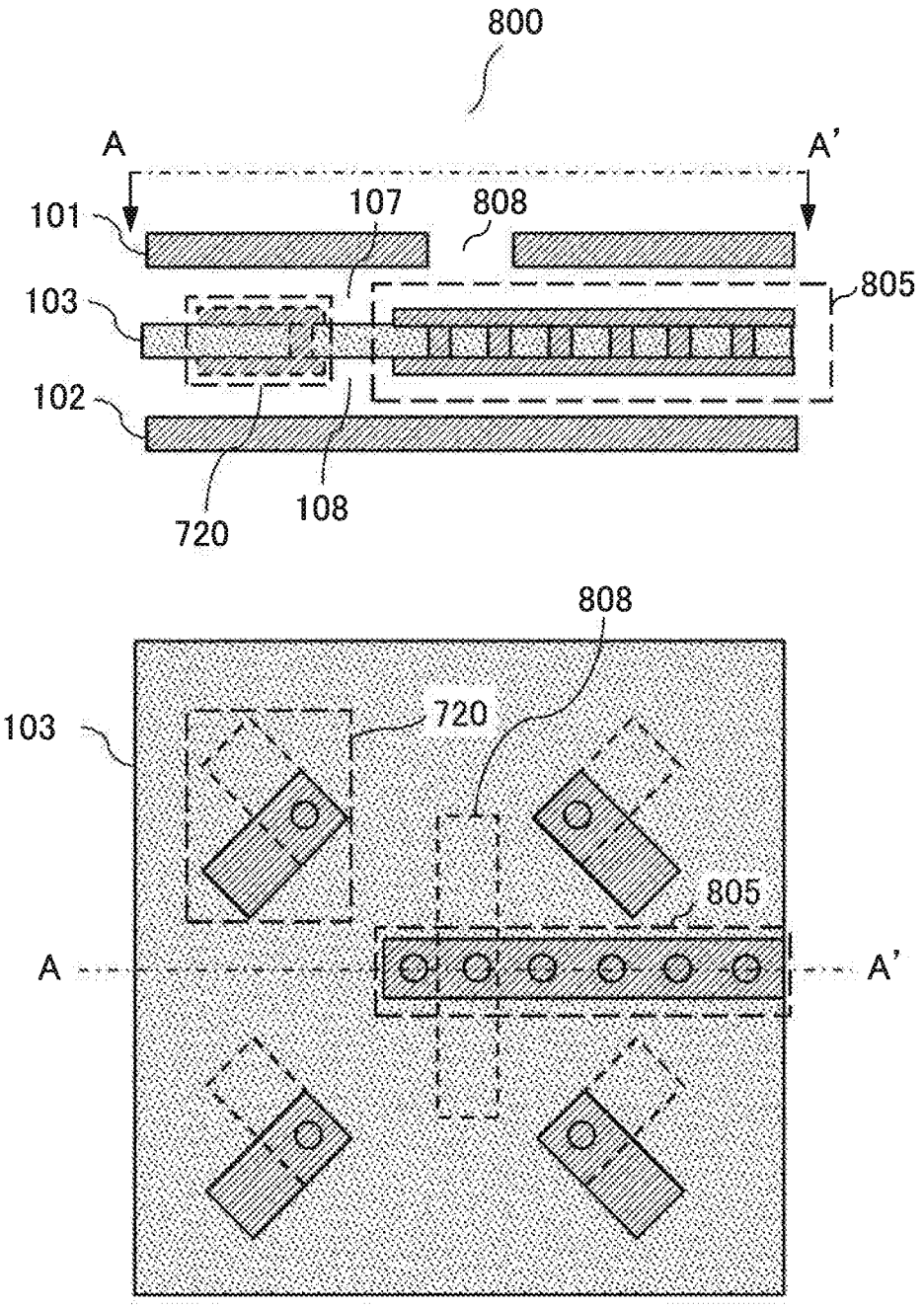
FIG. 13 is a diagram illustrating a configuration of the antenna structure 800 of the eighth example embodiment of the present disclosure.

The antenna structure 800 illustrated in FIG. 13 includes parallel flat plates configured by the first conductor plane 101 and the second conductor plane 102, and a dielectric plane 103 disposed between the first conductor plane 101 and the second conductor plane 102, each sandwiching the hollow regions 107 and 108. The dielectric plane 103 has a suspended strip line 805 one of whose ends is an open end and a plurality of unit structures 720, the unit structures 720 are disposed to surround the open end of the suspended strip line 805, and the first conductor plane 101 has a slot 808 at an opposed position to the open end of the suspended strip line 805 viewed from the direction perpendicular to the first conductor plane 101.

The slot 808 operates as an antenna element that receives the electromagnetic wave from outside and transmits to the suspended strip line 805, or in an opposite manner, emits the high frequency signal transmitted from the suspended strip line 805 to the outside.

The plurality of unit structures 720 are disposed to prevent the propagation of the leaked electromagnetic wave from the suspended strip line 805 to the inside of the parallel flat plates formed by the first conductor plane 101 and the second conductor plane 102, similar to the seventh example embodiment.

Ninth Example Embodiment

The structure body 900 of the ninth example embodiment of the present disclosure is described with reference to FIG. 14.

Figure 14:
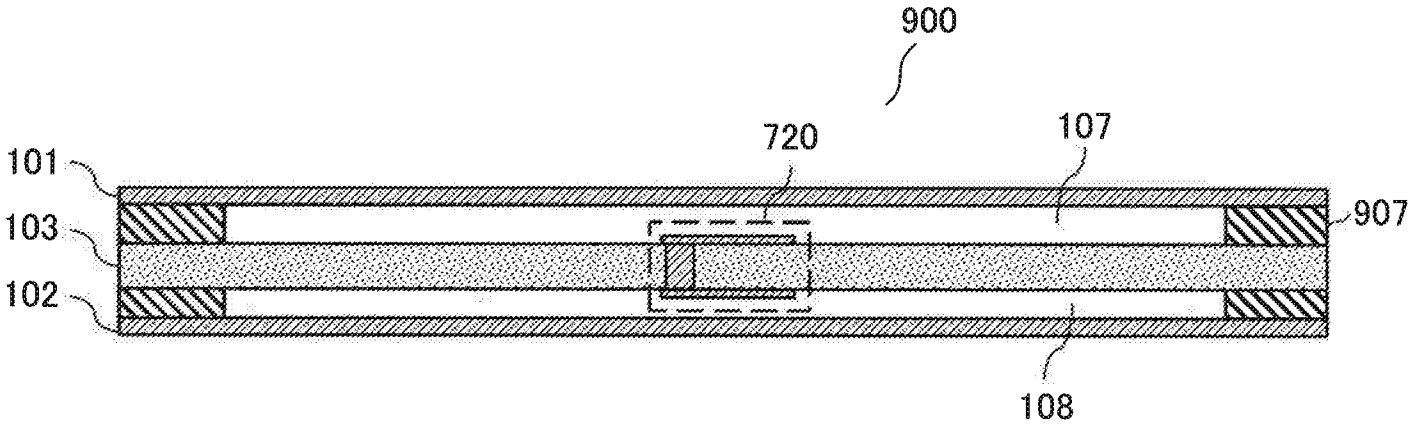
FIG. 14 is a diagram illustrating a configuration of the structure body 900 of the ninth example embodiment of the present disclosure.

The structure body 900 of FIG. 14 has a first conductor plane 101 and a second conductor plane 102 that are substantially parallel to each other, a conductor plane 103 disposed therebetween, a first and a second transmission lines disposed on the conductor plane 103, a conductor via, and hollow regions 107 and 108. In addition, a spacer 907 is disposed to the hollow regions 107 and 108 as a supporting member between the conductor plane and the dielectric plane in order to secure a constant thickness.

The material used for the spacer 907 may be any of conductor, dielectric, or magnetic substance as long as the mechanical strength is secured.

The spacer 907 is preferably disposed at a position far from the unit structure 720 in such a way as not to affect the operation thereof. The spacer 907 may not necessarily be electrically connected to the first conductor plane 101, the second conductor plane 102 and the dielectric plane 103.

The present invention has been described above with each example embodiment and the variation, however, the present invention is not limited to the above example embodiments. Within the scope of the present invention, the configuration and the detail of the present invention may be applied with various changes and combinations that may be understood by a person skilled in the art.

Each of the example embodiments described above may be described as the supplementary note below and is not limited.

(Supplementary Note 1)

A structure body including:

a first conductor plane and a second conductor plane disposed in parallel;

a dielectric plane that is disposed in parallel to the first conductor plane and the second conductor plane between the first conductor plane and the second conductor plane via a hollow region;

a first transmission line that is disposed on a surface facing the first conductor plane of the dielectric plane; and a second transmission line that is disposed on a surface facing the second conductor plane of the dielectric plane;

in which the first transmission line and the second transmission line are electrically connected to each other.

(Supplementary Note 2)

The structure body according to claim 1, in which the first transmission line and the second transmission line are provided with a plurality of branch wires whose lengths are different, respectively.

(Supplementary Note 3)

The structure body according to supplementary note 2, in which lengths $L_m$ from the connection of the first transmission line and the second transmission line the end of the plurality of branch wires satisfy $L_m=(2n+1)\times\lambda_m/4$, where $\lambda_m$ is a wavelength at an operating frequency and n is an integer equal to or larger than 0.

(Supplementary Note 4)

The structure body according to supplementary note 1, further including at least one suspended transmission line disposed on the dielectric plane, in which the first transmission line and the second transmission line are disposed around the suspended transmission line.

(Supplementary Note 5)

The structure body according to the supplementary note 4, including a plurality of unit structures configured by the first transmission line and the second transmission line, in which the plurality of unit structures are disposed to surround the suspended transmission line.

INDUSTRIAL APPLICABILITY

The application examples of the present invention are a communication device, antenna device or the like.

REFERENCE SIGNS LIST

100, 200 . . . 600, 900 Structure body
101 First conductor plane
102 Second conductor plane
103, 203 Dielectric plane
104, 304, 404, 604 First transmission line
105, 305, 405, 605 Second transmission line
106, 606 Conductor via
107, 108 Hollow region
509 Third transmission line
510 Fourth transmission line
511 Conductor via
512, 805 Suspended strip line
609 Transmission line
700 Layered structure
701 First conductor plane
702 Second conductor plane
703 Third conductor plane
704 First dielectric plane
705 Second dielectric plane
711 First suspended strip line
712 Second suspended strip line
720 Unit structure
800 Antenna structure
713, 808 Slot
907 Spacer

The invention claimed is:

1. A structure body comprising:

a first conductor plane and a second conductor plane disposed in parallel;

a dielectric plane that is disposed in parallel to the first conductor plane and the second conductor plane, and between the first conductor plane and the second conductor plane via a hollow region;

a first transmission line that is disposed on a surface facing the first conductor plane of the dielectric plane, at least one of whose ends is an open end; and a second transmission line that is disposed on a surface facing the second conductor plane of the dielectric plane, at least one of whose ends is an open end;

wherein the first transmission line and the second transmission line are electrically connected to each other, wherein the first transmission line and the second transmission line are disposed in such a way that open ends thereof overlap with each other when viewed from the direction perpendicular to the first conductor plane, and wherein a thickness of the dielectric plane is greater than a thickness of the hollow region.

2. The structure body according to claim 1, wherein the first transmission line and the second transmission line are disposed in such a way that open ends thereof do not overlap with each other when viewed from the direction perpendicular to the first conductor plane.

3. The structure body according to claim 1, wherein lengths L from the connection of the first transmission line and the second transmission line to open ends of the first transmission line and the second transmission line respectively satisfy $L=(2n+1)\times\lambda/4$, where $\lambda$ is a wavelength at an operating frequency and n is an integer equal to or larger than 0.

4. The structure body according to claim 1, wherein the first transmission line and the second transmission line are disposed in a folded manner.

5. The structure body according to claim 1, wherein each of the first transmission line and the second transmission line comprises a plurality of branch wires whose lengths are different.

6. The structure body according to claim 1, further comprising at least one spacer between the first conductor plane and the dielectric plane, and between the second conductor plane and the dielectric plane, respectively.

7. A structure body comprising:

a first conductor plane and a second conductor plane disposed in parallel;

a dielectric plane that is disposed in parallel to the first conductor plane and the second conductor plane, and between the first conductor plane and the second conductor plane via a hollow region;

a first transmission line that is disposed on a surface facing the first conductor plane of the dielectric plane, at least one of whose ends is an open end;

a second transmission line that is disposed on a surface facing the second conductor plane of the dielectric plane, at least one of whose ends is an open end; and at least one suspended transmission line disposed on the dielectric plane, wherein the first transmission line and the second transmission line are electrically connected to each other, and wherein the first transmission line and the second transmission line are disposed around the suspended transmission line.

8. A layered structure comprising:

a first conductor plane and a second conductor plane disposed in parallel;

a third conductor plane that is disposed in parallel to the first conductor plane and the second conductor plane, and in parallel to the surface of the second conductor plane opposite to the surface facing the first conductor plane;

a first dielectric plane that is disposed in parallel to the first conductor plane and the second conductor plane between the first conductor plane and the second conductor plane via a hollow region;

a second dielectric plane that is disposed in parallel to the second conductor plane and the third conductor plane between the second conductor plane and the third conductor plane via another hollow region;

a first transmission line that is disposed on a surface of the first dielectric plane facing the first conductor plane, and on a surface of the second dielectric plane facing the surface of the second conductor plane, and at least one end of which is an open end;

a second transmission line that is disposed on a surface of the first dielectric plane facing the second conductor plane and on a surface of the second dielectric plane facing the third conductor plane, and at least one end of which is an open end;

a first suspended transmission line that is disposed on the first dielectric plane, and one end of which is an open end; and a second suspended transmission line that is disposed on the second dielectric plane, and one of which is an open end;

wherein the second conductor plane includes an opening at a position opposing to an open end of the first suspended transmission line and an open end of the second suspended transmission line;

wherein the first transmission line and the second transmission line are electrically connected to each other; and a plurality of unit structures are disposed to surround open ends of the first suspended transmission line and the second suspended transmission line, where the unit structure is configured by the first transmission line and the second transmission line.

9. An antenna structure comprising:

a first conductor plane and a second conductor plane disposed in parallel;

a dielectric plane that is disposed in parallel to the first conductor plane and the second conductor plane between the first conductor plane and the second conductor plane via a hollow region;

a first transmission line that is disposed on a surface facing the first conductor plane of the dielectric plane, at least one end of which is an open end; and a second transmission line that is disposed on a surface of the dielectric plane facing the second conductor plane, at least one end of which is an open end; and a suspended transmission line that is disposed on the dielectric plane, and one of which is an open end;

wherein the first conductor plane includes an opening at a position opposing to an open end of the suspended transmission line;

the first transmission line and the second transmission line are electrically connected to each other; and a plurality of unit structures are disposed to surround an open end of the suspended transmission line, wherein the unit structure is configured by the first transmission line and the second transmission line.

* * * * *